US006219499B1

(12) United States Patent
Hayashi

(10) Patent No.: US 6,219,499 B1
(45) Date of Patent: Apr. 17, 2001

(54) DEVELOPING APPARATUS AND METHOD OF APPLYING DEVELOPING BIAS THEREFOR

(75) Inventor: Akihiro Hayashi, Okazaki (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/368,576

(22) Filed: Aug. 5, 1999

(30) Foreign Application Priority Data

Aug. 7, 1998 (JP) ..... 10-224961

(51) Int. Cl.[7] ..... G03G 15/06
(52) U.S. Cl. ..... 399/55; 399/235
(58) Field of Search ..... 399/29, 53, 55, 399/56, 234, 235, 254, 270, 285

(56) References Cited

U.S. PATENT DOCUMENTS 4,610,531 9/1986 Hayashi et al. ..... 399/270
5,534,982 7/1996 Sakaizawa et al. ..... 399/270
5,600,415 * 2/1997 Takahashi ..... 399/55
5,701,553 * 12/1997 Endo et al. ..... 399/55

* cited by examiner

*Primary Examiner*—Arthur T. Grimley
*Assistant Examiner*—Hoan Tran
(74) *Attorney, Agent, or Firm*—Burns, Doane, Swecker & Mathis, LLP

(57) ABSTRACT

In a developing apparatus of the present invention, a voltage applying circuit applies a developing bias voltage obtained by superimposing a DC component on an AC component to the developer carrying member. A bias voltage controller controls the voltage of the DC component based on at least one of a voltage range between the highest and lowest voltages of a waveform of the developing bias voltage and the ratio of time during which the waveform has a value higher or lower than a reference voltage to one period of the AC component. The reference voltage is set so that an area occupied by a portion of the waveform of the developing bias voltage in which the developing bias voltage has a value higher than the reference voltage is equal to an area occupied by a portion of the waveform in which the developing bias voltage has a value lower than the reference voltage.

23 Claims, 7 Drawing Sheets

DEVELOPING APPARATUS AND METHOD OF APPLYING DEVELOPING BIAS THEREFOR

This application is based on application No. 10-224961 filed in Japan, the contents of which is hereby incorporated by reference.

BACKGROUND OF THE INVENTION

1. Field of the Invention

The present invention relates to a developing bias control system for controlling a developing bias in an image forming apparatus such as a copier or a laser printer.

2. Description of the Related Art

In a conventional image forming apparatus, the surface of a photosensitive member uniformly charged by a charging unit is exposed by using an exposing unit such that an electrostatic latent image is formed thereon. The electrostatic latent image is then changed to a visible image with a toner and the resulting toner image is transferred onto a transfer material. As a developing method adopted in the case of using a magnetic single-component developing scheme in a developing process in which the electrostatic latent image is changed to a visible image with a toner, there is a non-contact developing method whereby development is conducted by allowing a toner to fly between the surface of the photosensitive member and a developing apparatus for supplying the toner.

FIG. 7 is a view for illustrating the non-contact developing method. In the drawing, 901 denotes a developing sleeve, 902 denotes a magnet roller, and 903 denotes a magnetic blade. In accordance with the non-contact developing method, a toner on the developing sleeve 901 is kept from contact with a photosensitive drum 905 and development is conducted by allowing the toner to fly in the space therebetween (hereinafter referred to as "developing gap"), as shown in the drawing.

Specifically, the toner is triboelectrically charged by means of the developing sleeve 901 and the magnetic blade 903 to form a thin-film toner layer on the developing sleeve 901. Thereafter, the toner layer is brought closer to the surface of the photosensitive drum 905 by the rotation of the developing sleeve 901. In the mean time, a developing bias is applied from a developing bias power source 904 to allow the toner to fly in the developing gap, whereby development is conducted. As the developing bias, a developing bias voltage obtained by superimposing a direct-current (hereinafter referred to as "DC") voltage on an alternating-current (hereinafter referred to as "AC") voltage is applied. In this case, the upper voltage time rate of the AC voltage or the lower voltage time rate thereof is usually set to 50%.

Here, "upper voltage time rate or lower voltage time rate" is defined as a rate, of one period of the AC component, constituted by a time during which the AC voltage has a value higher or lower than a reference voltage. The reference voltage is set such that an area occupied by a portion of one cycle of the signal waveform of the AC voltage in which the AC voltage has a value higher than a given voltage (hereinafter referred to as "area middle voltage") as the reference voltage becomes equal to an area occupied by a portion of the signal waveform in which the AC voltage has a value lower than the given voltage.

A description will be given to the waveform in the case of applying the developing bias voltage obtained by superimposing the DC voltage on the rectangular-wave AC voltage.

FIG. 8 is a view diagrammatically showing the signal waveform of the developing bias voltage in the case of superimposing the DC voltage at −250 V on the rectangular-wave AC voltage at a 50% upper or lower voltage time rate.

As shown in FIG. 8, the developing bias voltage has a value of −250 V in the middle of the upper and lower peak voltages (hereinafter referred to as "$V_{p-p}$ middle", in which p-p stands for "peak to peak"). On the other hand, the voltage in the middle (hereinafter referred to as "area middle") at which the area of the region surrounded by the peak portion of the AC voltage waveform (area of the hatched portion A in the drawing) coincides with the area of the region surrounded by the valley portion thereof (area of the hatched portion B in the drawing), i.e., the area middle voltage mentioned above also becomes −250 V.

As described above, if the upper voltage time rate or the lower voltage time rate is 50%, the voltage in the $V_{p-p}$ middle and the area middle voltage are equal to each other and to the superimposed DC voltage.

To obtain a proper solid density by controlling a developing density in the case of using the non-contact developing method, it is preferable to freely control the upper or lower voltage time rate of the rectangular-wave AC voltage applied as the developing bias and a voltage range between the upper and lower peak voltages (hereinafter referred to as "upper-to-lower voltage range" or "$V_{p-p}$"). This is because the non-contact developing method is, namely, a developing method utilizing the reciprocal movement of the toner in the developing gap caused with the application of the AC voltage so that the upper or lower voltage time rate or the value of $V_{p-p}$ affects such reciprocal movement of the toner.

If the upper or lower voltage time rate is controlled to be other than 50%, however, the following problems occur. FIG. 9 is a view for illustrating the problems.

As the developing bias, it is normally preferred to cause the voltage in the $V_{p-p}$ middle of the rectangular-wave AC voltage to coincide with the surface potential of the photosensitive member or the like (in the example of FIG. 9, the surface potential of the photosensitive member or the like is assumed to be −250 V).

The reason for this is that, in principle, $V_{p-p}$ is preferably maximized in the non-contact developing method. Specifically, the problem of degraded halftone reproduction occurs if $V_{p-p}$ can be set only to a value smaller than required.

If the upper and lower peak voltages exceed a discharge limit as a result of increasing $V_{p-p}$, on the other hand, a discharge occurs in the developing gap, which degrades image quality. To maximize $V_{p-p}$ such that the discharge limit is not surpassed, therefore, it is preferable to cause the voltage in the $V_{p-p}$ middle to coincide with the surface potential of the photosensitive member.

If the upper or lower voltage time rate is other than 50%, however, the problem occurs that the DC voltage is not necessarily a voltage in the $V_{p-p}$ middle even when the DC voltage to be superimposed is caused to coincide with the potential at the surface of the photosensitive member. This is because, in accordance with the principle of the AC transformer, the DC voltage to be superimposed becomes the area middle voltage, not the voltage in the $V_{p-p}$ middle. If the DC voltage to be superimposed is controlled to coincide with the potential at the surface of the photosensitive member, therefore, there are cases where the peak value of the rectangular-wave AC voltage exceeds the discharge limit. The problem encountered when $V_{p-p}$ is reduced such that the discharge limit is not surpassed is as described above.

SUMMARY OF THE INVENTION

The present invention has been achieved in view of the foregoing problems. It is therefore an object of the present invention to provide a developing bias control system capable of optimizing the position of the voltage in the $V_{p-p}$ middle even if the upper or lower voltage time rate or upper-to-lower voltage range of the AC voltage to be applied are to be varied in an image forming apparatus.

To solve the foregoing problems, a developing apparatus according to the present invention has: a developer carrying member which carries a developer; a voltage applying circuit which applies a developing bias voltage obtained by superimposing a DC component on an AC component to the developer carrying member; and a bias voltage controller which controls the voltage of the DC component based on a ratio of time during which the developing bias voltage has a value higher or lower than a reference voltage to one period of the AC component, said reference voltage being set so that a first area is equal to a second area, the first area being occupied by a portion of a waveform of the developing bias voltage in which the developing bias voltage has a value higher than the reference voltage and the second area being occupied by a portion of the waveform in which the developing bias voltage has a value lower than the reference voltage.

A developing apparatus according to the present invention includes: a developer carrying member which carries a developer; a voltage applying circuit which applies a developing bias voltage obtained by superimposing a DC component on an AC component to the developer carrying member; and a bias voltage controller which controls the voltage of the DC component based on a voltage range between the highest and lowest voltages of a waveform of the developing bias voltage.

Since the voltage of the DC component to be superimposed is controlled based on at least one of the voltage time ratio and the voltage range, the voltage of the DC component can be controlled appropriately even if one or each of the upper-to-lower voltage range and the voltage time rate varies.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
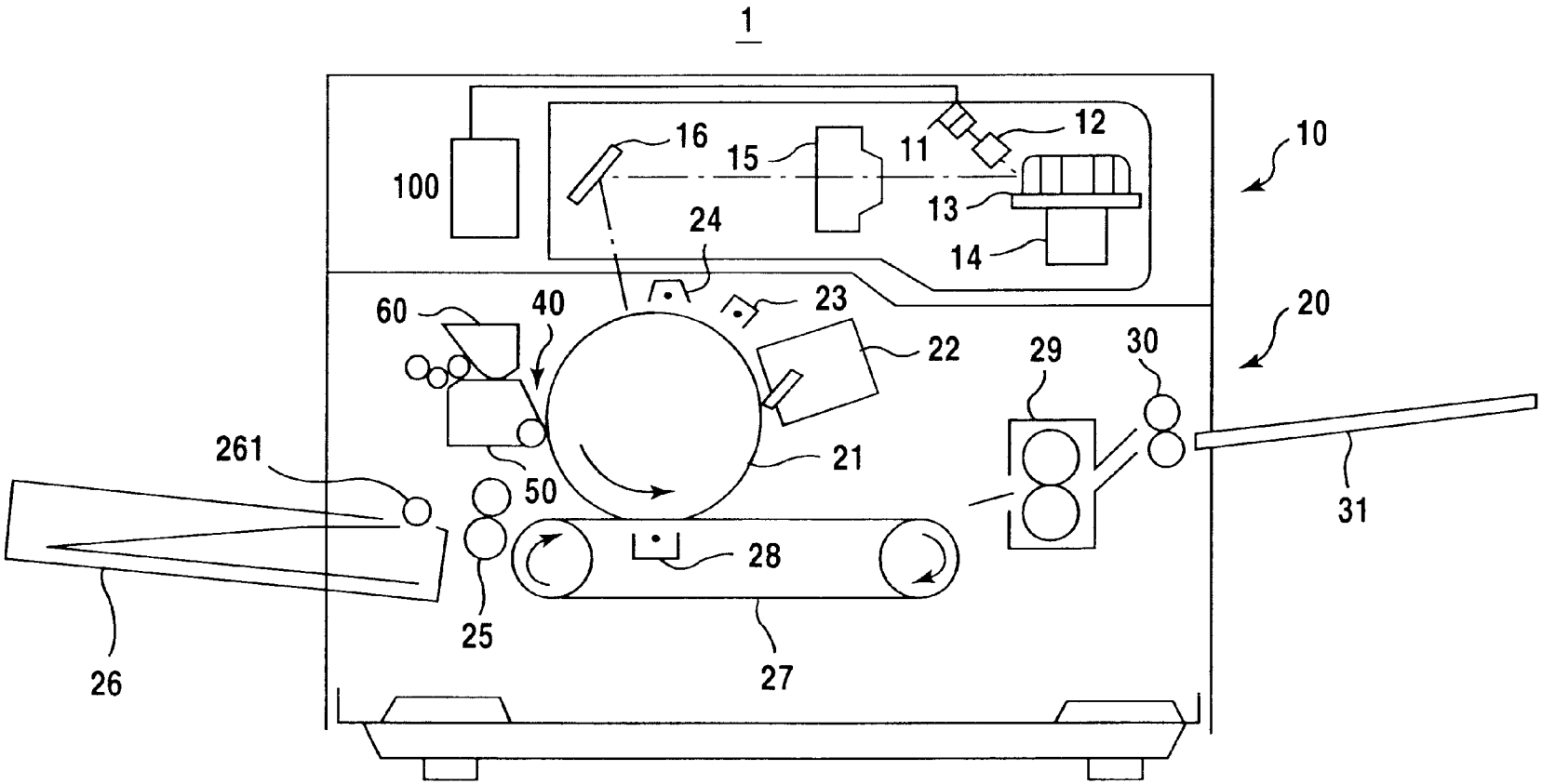
FIG. 1 is a schematic cross-sectional view of an image forming apparatus to which the present invention is applied.

Referring now to the drawings, an embodiment when the present invention is applied to an image forming apparatus will be described as an example of application of a developing bias control system according to the present invention.

(1) Overall Structure of Image Forming Apparatus

In FIG. 1 is shown a schematic cross-sectional view of the image forming apparatus according to the present embodiment. As shown in the drawing, the image forming apparatus of the present embodiment can be divided into a scan-exposing unit 10 and an image forming unit 20.

The image forming apparatus of the present embodiment can be connected to, e.g., an external computer, image reader, or the like which is not shown. A control unit 100 performs necessary processing with respect to an image signal transmitted from the external computer or the like and outputs a drive signal to a laser diode (hereinafter referred to as "LD") 11 based on the image data generated.

The LD 11 emits a laser beam upon receipt of the drive signal. The laser beam passes through a collimate lens 12 to form parallel light, which is further reflected and polarized by the mirror surface of a polygon mirror 13 rotatively driven at a constant speed by a polygon motor 14.

The polarized laser beam passes through a fθ lens 15 to be reflected by a reflecting mirror 16 and used to scan-expose the surface of the photosensitive drum 21.

Prior to exposure, the photosensitive drum 21 of the image forming unit 20 had a residual toner on the surface of the photosensitive member removed therefrom by means of a cleaner 22 and is further discharged under radiation from an eraser lamp 23 before it is uniformly charged by a charger 24. An electrostatic latent image is formed on the surface of the photosensitive drum 21 when scanning exposure is performed with respect to the photosensitive drum 21 thus uniformly charged.

With the electrostatic latent image being changed to a visible image by the developing apparatus 40, a toner image is formed on the surface of the photosensitive drum 21. The developing apparatus 40 is composed of a developing unit 50 including a developing sleeve and an agitator and a toner vessel 60 for appropriately supplying a toner into a developing unit 50. The developing apparatus 40 according to the present embodiment is a non-contact developing apparatus which keeps the developing sleeve from contact with the photosensitive drum 21 and develops the latent image formed on the photosensitive member without making contact with the photosensitive member. As the developing bias, a normal developing bias obtained by superimposing a DC voltage on a rectangular-wave AC voltage is applied. The developing bias to be applied is controlled by a voltage control unit 200 shown in FIG. 2. The control of the voltage to be applied by the voltage control unit 200 will be described later. Thus, the developing apparatus forms the latent image on the photosensitive member without making contact with the photosensitive member.

A transfer member which is not shown and set to a cassette 26 in synchronization with the rotating operation of the photosensitive drum 21 is transported to a transfer position under the photosensitive drum 21 by a paper supply roller 261, a pair of timing rollers 25, and a transport belt 27, where the toner image formed on the surface of the photosensitive drum 21 is transferred onto the transfer member with charges from a transfer charger 28 disposed on the back face of the transport belt 27.

The transfer member onto which the toner image has been transferred is transported to a fixer unit 29 by the transport belt 27, where it is fixed at a high temperature under pressure and discharged onto a discharge tray 31 by a pair of discharge rollers 30.

(2) Structure of Voltage Control Unit 200

Figure 2:
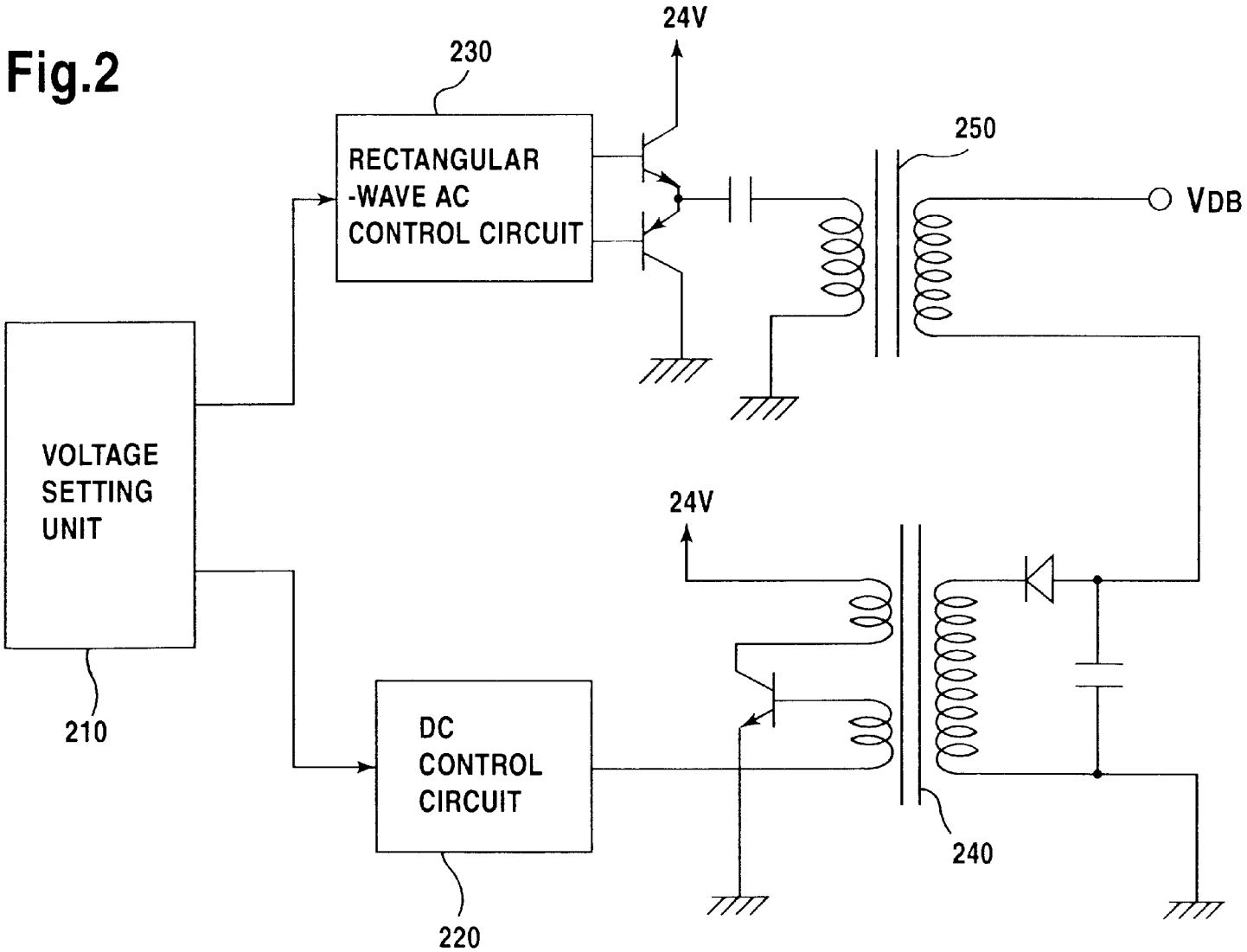
FIG. 2 is a view showing a structure of a power-source control unit in an embodiment of the present invention.

Referring to FIG. 2, a structure of the voltage control unit 200 according to the present embodiment will be described below.

As shown in the drawing, the structure of the voltage control unit 200 according to the present embodiment includes a voltage setting unit 210, a DC control circuit 220, a rectangular-wave AC control circuit 230, a DC high-voltage transformer 240, and an AC high-voltage transformer 250 to output a developing bias $V_{DB}$.

The voltage setting unit 210 sets the upper-to-lower voltage range ($V_{p-p}$) of the waveform of the developing bias voltage, the upper or lower voltage time rate, and the DC voltage to be superimposed and controls the DC control circuit 220 and the rectangular-wave AC control circuit 230. The essence of the present invention is to determine the DC voltage to be superimposed and control the DC control circuit 220 based on the target voltage of the voltage in the $V_{p-p}$ middle calculated on the basis of image forming conditions and the like, the value of $V_{p-p}$, and the upper or lower voltage time rate of the waveform of the developing bias voltage.

It is to be noted that "upper voltage time rate or lower voltage time rate" is defined as the rate, of one period of the developing bias voltage, constituted by a time during which the developing bias voltage has a value higher or lower than a reference voltage. The reference voltage is set such that an area occupied by a portion of one cycle of the signal waveform of the AC voltage in which the developing bias voltage has a value higher than a given voltage (hereinafter referred to as "area middle voltage") as the reference voltage becomes equal to an area occupied by a portion thereof in which the developing bias voltage has a value lower than the given voltage. Hereinafter, the upper voltage time rate and the lower voltage time rate will be termed High-duty and Low-duty, respectively. On the other hand, "$V_{p-p}$" is defined as a voltage range (potential difference) between the highest and lowest voltages of the signal waveform of the developing bias voltage and "voltage in the $V_{p-p}$ middle" is defined as a middle voltage value between the highest and lowest voltages.

The DC control circuit 220 and the rectangular-wave AC control circuit 230 perform control operation such that a voltage appropriate as the developing bias $V_{DB}$ is output based on the upper or lower voltage time rate, the value of $V_{p-p}$, the target voltage in the $V_{p-p}$ middle, or the like which has been set by the voltage setting unit 210. Since the details of the DC control circuit 220 and the rectangular-wave AC control circuit 230 are well-known technology, the detailed description thereof is omitted here.

(3) Developing Bias Control Operation

Next, a description will be given to a developing bias control operation in the voltage control unit 200 thus structured.

Figure 3:
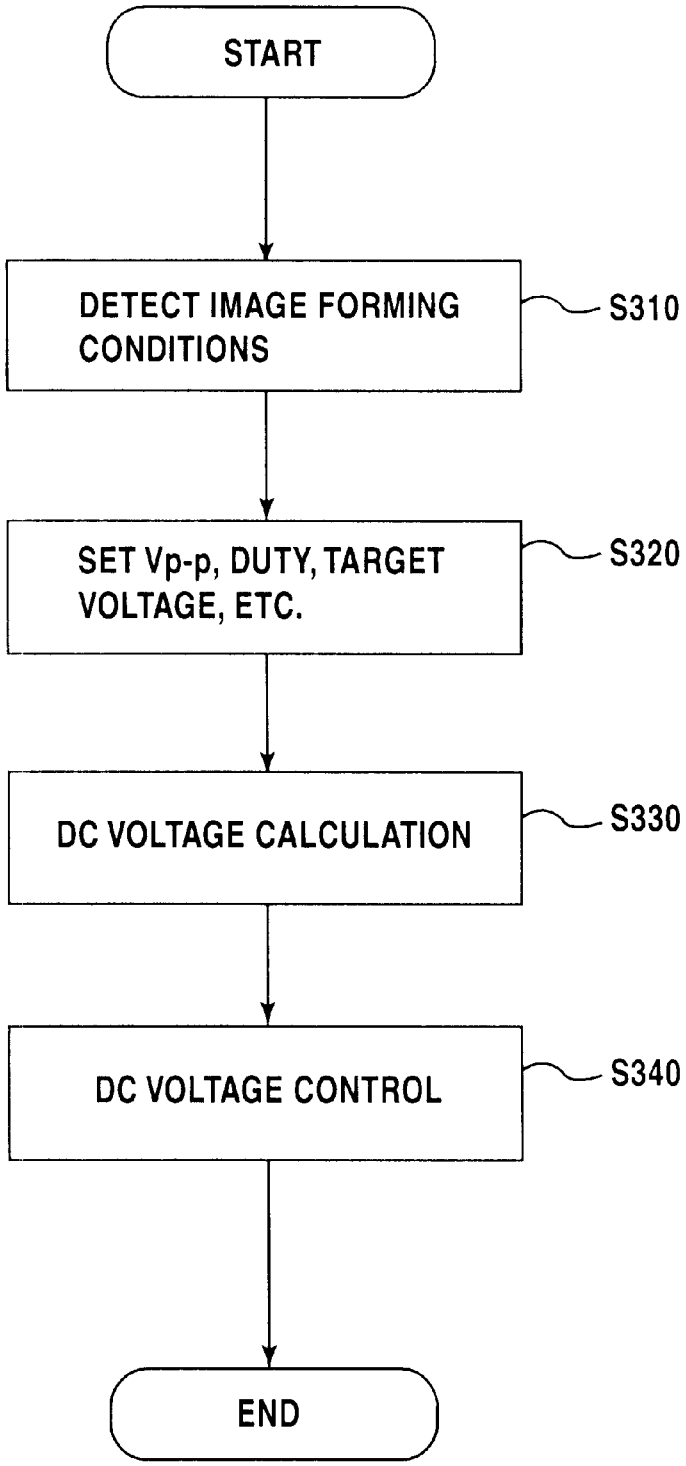
FIG. 3 is a flow chart showing in detail a bias control operation in the present embodiment.

FIG. 3 is a flow chart showing the details of the developing bias control operation of the present embodiment. As shown in the drawing, the voltage setting unit 210 initially detects such image forming conditions as a toner density in the developing unit and a printing density (S310) to set the upper-to-lower voltage range ($V_{p-p}$), the upper or lower voltage time rate, a surface potential of the photosensitive member (the target voltage of the voltage in the $V_{p-p}$ middle), or the like (S320).

Next, the DC voltage ($V_{DC}$) to be superimposed is calculated (S330). In the present embodiment, the DC voltage is calculated by using the following numeric expression.

$$V_{DC}=V_{offset}+(V_{p-p}/2)-(V_{p-p}\times\text{Low-duty}/100)$$

Here, $V_{offset}$ is the target voltage (in the unit V) of the voltage in the $V_{p-p}$ middle and is normally caused to coincide with the surface potential of the photosensitive member. On the other hand, $V_{p-p}$ is the upper-to-lower voltage range and Low-duty is the rate (in the unit %), of one period of the rectangular-wave AC voltage, constituted by a time during which the developing bias voltage has a value lower than the area middle voltage.

Of the foregoing parameters, one or more may have fixed values. Instead of Low-duty, High-duty may be used in the numerical expression.

Thus, the DC voltage $V_{DC}$ calculated from the numerical expression becomes the DC voltage value in the area middle such that the voltage value in the $V_{p-p}$ middle coincides with the surface potential of the photosensitive member or the like even if the upper or lower voltage time rate or $V_{p-p}$ varies.

Figure 4:
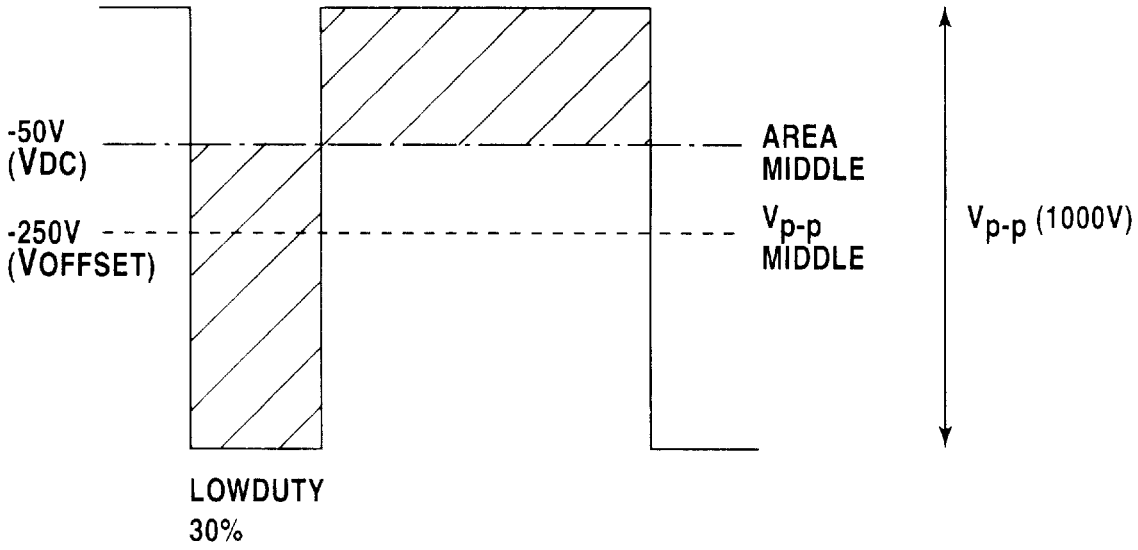
FIG. 4 is a view showing an example of the signal waveform of a developing bias voltage under the developing bias control according to the present embodiment.

After calculating the $V_{DC}$ based on the numerical expression, the voltage setting unit 210 controls the DC control circuit 220 based on the calculated value of $V_{p-p}$ to control the DC voltage (S340). In FIG. 4 is shown an example of the waveform of the developing bias voltage in the case of controlling the DC voltage by means of the developing bias control system according to the present embodiment. FIG. 4 shows, by way of example, the case where Low-duty and $V_{p-p}$ are to be controlled to be 30% and 1000 V, respectively when the potential ($V_{offset}$) at the surface of the photosensitive member is −250 V.

As can be seen from FIG. 4, the developing bias is controlled such that the voltage in the $V_{p-p}$ middle has an appropriate constant value of −250 V if the DC voltage to be superimposed is controlled to be −50 V, which is the value of $V_{DC}$ calculated based on the foregoing numerical expression.

Figure 5:
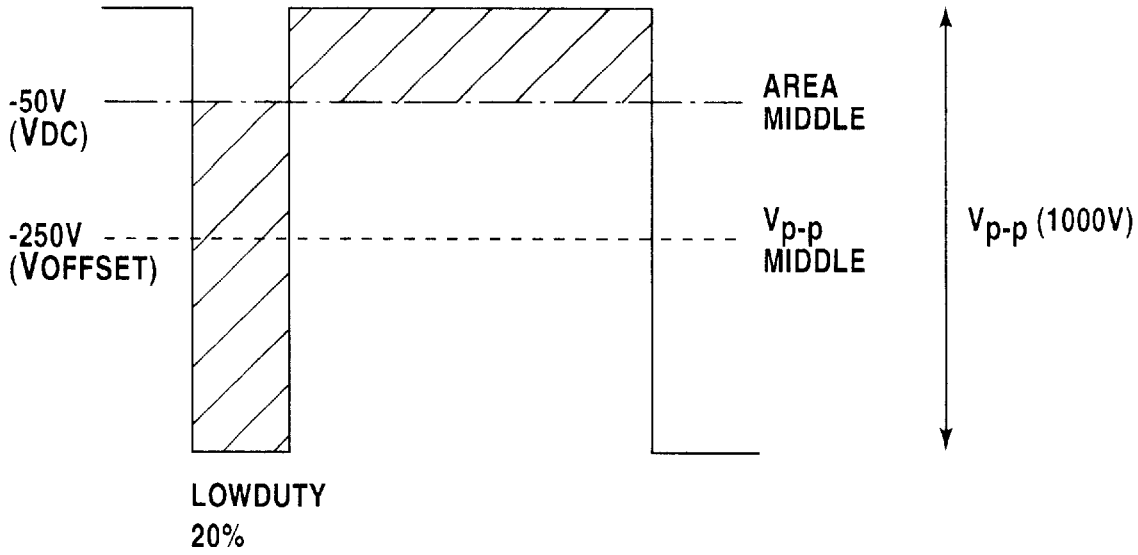
FIG. 5 is a view for illustrating the control of a DC voltage in the case of varying an upper or lower voltage time rate.

FIG. 5 is a view showing, by way of example, the case where Low-duty is to be controlled to be 20% when the potential at the surface of the photosensitive member is −250 V and $V_{p-p}$ is 1000 V.

Figure 6:
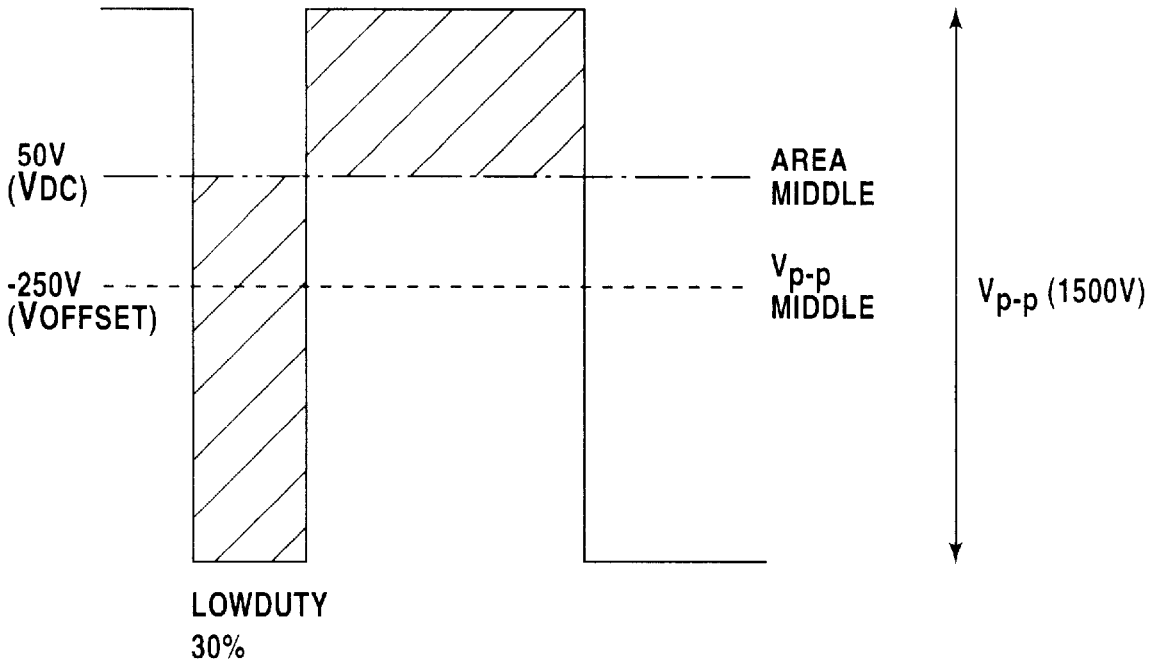
FIG. 6 is a view for illustrating the control of a DC voltage in the case of varying an upper-to-lower voltage range.
Figure 7:
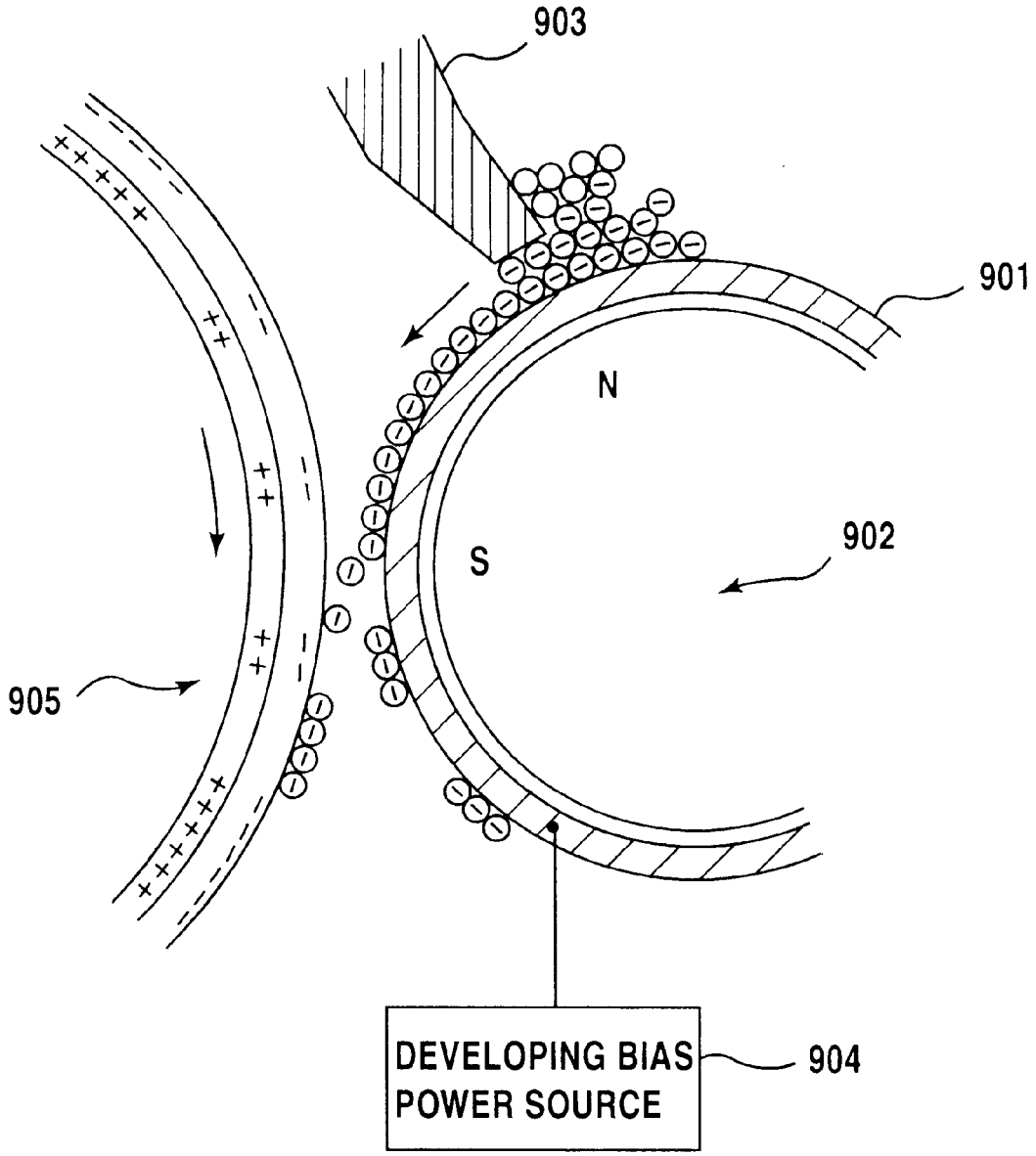
Fig.7 PRIOR ART
FIG. 7 is a view for illustrating a conventional non-contact developing method.
Figure 8:
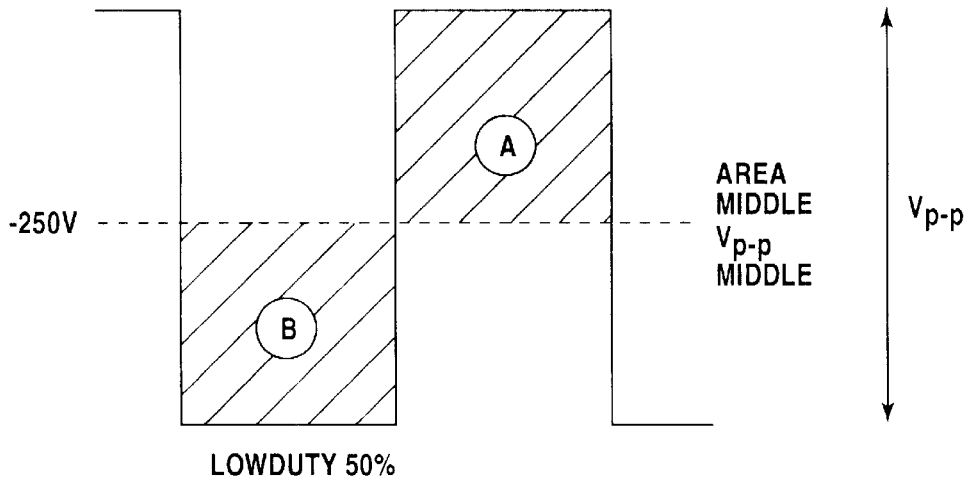
Fig.8 PRIOR ART
FIG. 8 is a view for illustrating a developing bias voltage in accordance with the conventional non-contact developing method.
Figure 9:
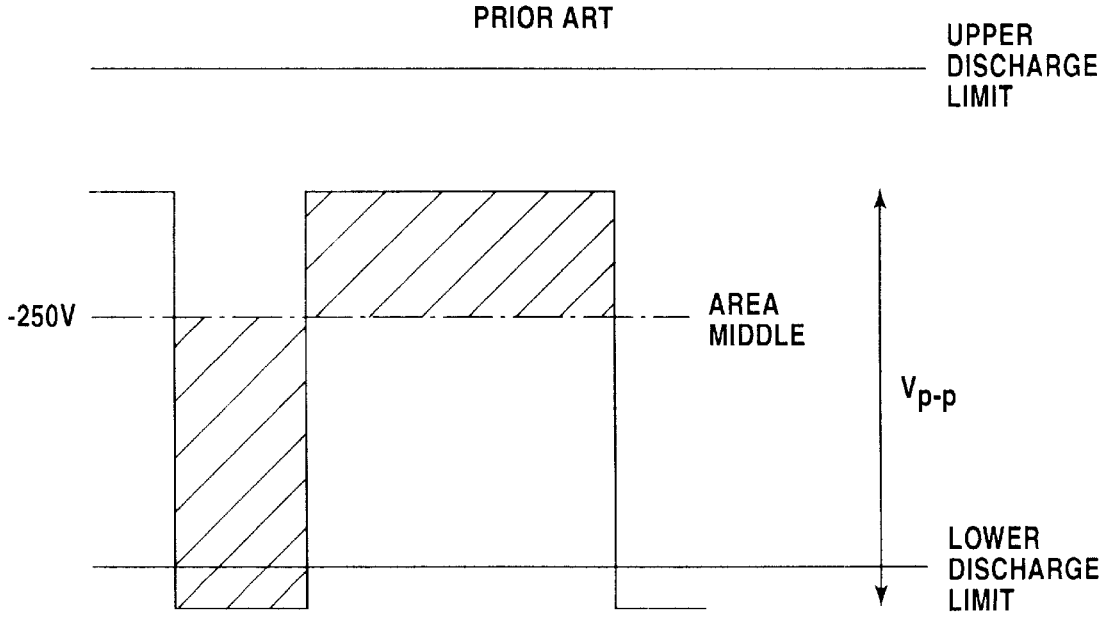
Fig.9 PRIOR ART
FIG. 9 is a view for illustrating the problems presented by conventional developing bias control.

FIG. 6 is a view showing, by way of example, the case where $V_{p-p}$ is to be controlled to be 1500 V when the potential on the surface of the photosensitive member is −250 V and Low-duty is 30%. In this case, the value of $V_{DC}$ is controlled adequately to be 50 V based on the foregoing numerical expression, as shown in the drawing.

As described above, the position of the voltage in the $V_{p-p}$ middle can be optimized under control by using the developing bias control system according to the present embodiment even if the upper or lower voltage time rate or upper-to-lower voltage range ($V_{p-p}$) of the rectangular-wave AC voltage portion to be applied as the developing bias is to be varied.

Variations

It will be appreciated that the technical scope of the present invention is not limited to the foregoing embodiments. For example, it is possible to consider the following variations.

(1) Although each the foregoing embodiments has described the case where the present invention is applied to an electrophotographic image forming apparatus, the present invention is also applicable to various other image forming apparatus including one adopting a direct recording method whereby a latent image is directly developed by using, e.g., a multi-stylus (needle electrode) and one causing a toner to fly with an electric field curtain.

(2) Each of the foregoing embodiments has also described the case where the waveform of the AC voltage is that of a rectangular wave. This is because the use of the rectangular wave is suitable for controlling the flight of the toner. However, it will be appreciated that the application of the present invention is not limited to the case of using the rectangular wave. The present invention is also applicable to the case of using a normal alternating current, a trapezoidal wave, or the like provided that the waveform exhibits periodic variations. In that case, it is also possible to correct the foregoing numerical expression to provide an expression for calculating the DC voltage to be superimposed.

As described above, in the developing bias control system according to the present invention, the voltage of the DC component to be superimposed is controlled based on at least one of a voltage range (upper-to-lower voltage range) between the highest and lowest voltages of the signal waveform of the developing bias voltage and the rate (upper or lower voltage time rate), of one period of the AC component, constituted by a time during which the developing bias voltage has a value higher or lower than a reference voltage, the reference voltage being set such that an area occupied by a portion of the signal waveform of the developing bias voltage in which the developing bias voltage has a value higher than a given voltage as the reference voltage becomes equal to an area occupied by a portion of the signal waveform in which the developing bias voltage has a value lower than the given voltage. When the developing bias voltage obtained by superimposing a DC voltage on an AC voltage is applied to a developer carrying member in an image forming apparatus adopting a non-contact developing method, even if the upper or lower voltage time rate of the AC voltage portion or the upper-to-lower voltage range ($V_{p-p}$) is to be varied, there is achieved the effect of controlling the DC voltage to be superimposed such that the position of the $V_{p-p}$ middle is optimized.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A developing apparatus comprising:

a developer carrying member which carries a developer;

a voltage applying circuit which applies a developing bias voltage obtained by superimposing a DC component on an AC component to the developer carrying member; and a bias voltage controller which controls the voltage of the DC component based on a ratio of time during which the developing bias voltage has a value higher or lower than a reference voltage to one period of the AC component, said reference voltage being set so that a first area is equal to a second area, the first area being occupied by a portion of a waveform of the developing bias voltage in which the developing bias voltage has a value higher than the reference voltage and the second area being occupied by a portion of the waveform in which the developing bias voltage has a value lower than the reference voltage.

2. A developing apparatus as claimed in claim 1, wherein said bias voltage controller controls the voltage of the DC component so that a middle voltage value between the highest and lowest voltages of the waveform of the developing bias voltage coincides with a prescribed value.

3. A developing apparatus as claimed in claim 1, wherein said bias voltage controller controls the voltage of the DC component based on a voltage range between the highest and lowest voltages of a waveform of the developing bias voltage.

4. A developing apparatus as claimed in claim 3, wherein said bias voltage controller controls the voltage of the DC component by using the following numeric expression, $$V_{DC}=V_{offset}+(V_{p-p}/2)-(V_{p-p}\times\text{Low-duty}/100)$$

Wherein:

$V_{offset}$: a target voltage of a middle voltage value between the highest and lowest voltages;

$V_{p-p}$: the voltage range value between the highest and lowest voltages; and

Low-duty: the ratio of time during which the waveform has a value lower than the reference voltage to one period of the AC component.

5. A developing apparatus as claimed in claim 1, wherein said developer carrying member develops a latent image formed on a photosensitive member without making contact with the photosensitive member.

6. A developing apparatus as claimed in claim 1, wherein said AC component of the developing bias voltage has a rectangular waveform.

7. A developing apparatus comprising:

a developer carrying member which carries a developer;

a voltage applying circuit which applies a developing bias voltage obtained by superimposing a DC component on an AC component to the developer carrying member; and a bias voltage controller which controls the voltage of the DC component based on a middle value of a voltage range between the highest and lowest voltages of a waveform of the developing bias voltage.

8. A developing apparatus according to claim 7, wherein said bias voltage controller controls the voltage of the DC component by using the following numeric expression, $$V_{DC}=V_{offset}+(V_{p-p}/2)-(V_{p-p}\times\text{Low-duty}/100)$$

wherein:

$V_{offset}$: a target voltage of the middle voltage value between the highest and lowest voltages;

$V_{p-p}$: the voltage range value between the highest and lowest voltages; and

Low-duty: the ratio of time during which the waveform has a value lower than the reference voltage to one period of the AC component.

9. A method of applying a developing bias for applying, in an image forming apparatus comprising a developer carrying member, a developing bias voltage obtained by superimposing a DC component on an AC component to the developer carrying member, the method comprising the steps of:

acquiring information representing a ratio of time during which the developing bias voltage has a value higher or lower than a reference voltage to one period of the AC component, said reference voltage being set so that a first area is equal to a second area, the first area being occupied by a portion of a waveform of the developing bias voltage in which the developing bias voltage has a value higher than the reference voltage and the second area being occupied by a portion of the waveform in which the developing bias voltage has a value lower than the reference voltage;

determining the voltage of the DC component to be superimposed based on the acquired information; and superimposing the voltage of the determined DC component on the AC component and applying the developing bias voltage to the developer carrying member.

10. A method of applying a developing bias as claimed in claim 9, wherein said voltage of the DC component is determined so that a middle voltage value between the highest and lowest voltages of the waveform of the developing bias voltage coincides with a prescribed value.

11. A method of applying a developing bias as claimed in claim 9, wherein said voltage of the DC component is determined by using the following numeric expression, $$V_{DC}=V_{offset}+(V_{p\text{-}p}/2)-(V_{p\text{-}p}\times\text{Low-duty}/100)$$

Wherein:

$V_{offset}$: a target voltage of a middle voltage value between the highest and lowest voltages;

$V_{p\text{-}p}$: the voltage range value between the highest and lowest voltages; and Low-duty: the ratio of time during which the waveform has a value lower than the reference voltage to one period of the AC component.

12. A method of applying a developing bias as claimed in claim 9, wherein said developer carrying member develops a latent image formed on a photosensitive member without making contact with the photosensitive member.

13. A method of applying a developing bias as claimed in claim 9, wherein said AC component of the developing bias voltage has a rectangular waveform.

14. A method of applying a developing bias as claimed in claim 9, further comprising the steps of:

detecting image forming conditions of the image forming apparatus and setting said ratio of time based on the detected image forming conditions.

15. A method of applying a developing bias for applying, in an image forming apparatus comprising a developer carrying member, a developing bias voltage obtained by superimposing a DC component on an AC component to the developer carrying member, the method comprising the steps of:

acquiring information representing a middle voltage value of a voltage range between the highest and lowest voltages of a waveform of the developing bias voltage;

determining the voltage of the DC component to be superimposed based on the acquired information; and superimposing the voltage of the determined DC component on the AC component and applying the developing bias voltage to the developer carrying member.

16. A developing apparatus according to claim 15, wherein said bias voltage controller controls the voltage of the DC component by using the following numeric expression, $$V_{DC}=V_{offset}+(V_{p\text{-}p}/2)-(V_{p\text{-}p}\times\text{Low-duty}/100)$$

wherein:

$V_{offset}$: a target voltage of the middle voltage value between the highest and lowest voltages;

$V_{p\text{-}p}$: the voltage range value between the highest and lowest voltages; and Low-duty: the ratio of time during which the waveform has a value lower than the reference voltage to one period of the AC component.

17. An image forming apparatus comprising:

an image forming unit which forms image based on image data;

a developer carrying member provided in the image forming unit and carrying a developer;

a voltage applying circuit which applies a developing bias voltage obtained by superimposing a DC component on an AC component to the developer carrying member; and a bias voltage controller which controls the voltage of the DC component to be superimposed based on a ratio of time during which the developing bias voltage has a value higher or lower than a reference voltage to one period of the AC component, said reference voltage being set so that a first area is equal to a second area, the first area being occupied by a portion of a waveform of the developing bias voltage in which the developing bias voltage has a value higher than the reference voltage and the second area being occupied by a portion of the waveform in which the developing bias voltage has a value lower than the reference voltage.

18. An image forming apparatus as claimed in claim 17, wherein said bias voltage controller controls the voltage of the DC component based on a voltage range between the highest and lowest voltages of a waveform of the developing bias voltage.

19. An image forming apparatus as claimed in claim 17, wherein said bias voltage controller controls the voltage of the DC component by using the following numeric expression, $$V_{DC}=V_{offset}+(V_{p\text{-}p}/2)-(V_{p\text{-}p}\times\text{Low-duty}/100)$$

Wherein:

$V_{offset}$: a target voltage of a middle voltage value between the highest and lowest voltages;

$V_{p\text{-}p}$: the voltage range value between the highest and lowest voltages; and Low-duty: the ratio of time during which the waveform has a value lower than the reference voltage to one period of the AC component.

20. An image forming apparatus as claimed in claim 17, further comprising:

a detector which detects image forming conditions of the image forming apparatus; and a setting means for setting said ratio of time based on the detected image forming conditions.

21. An image forming apparatus comprising:

an image forming unit which forms image based on image data;

a developer carrying member provided in the image forming unit and carrying a developer;

a voltage applying circuit which applies a developing bias voltage obtained by superimposing a DC component on an AC component to the developer carrying member; and a bias voltage controller which controls the voltage of the DC component to be superimposed based on a middle voltage value of a voltage range between the highest and lowest voltages of a waveform of the developing bias voltage.

22. A developing apparatus according to claim 21, wherein said bias voltage controller controls the voltage of the DC component by using the following numeric expression, $$V_{DC}=V_{offset}+(V_{p\text{-}p}/2)-(V_{p\text{-}p}\times\text{Low-duty}/100)$$

wherein:

$V_{offset}$: a target voltage of the middle voltage value between the highest and lowest voltages;

$V_{p\text{-}p}$: the voltage range value between the highest and lowest voltages; and Low-duty: the ratio of time during which the waveform has a value lower than the reference voltage to one period of the AC component.

23. A developing apparatus comprising:

a developer carrying member which carries a developer;

a voltage applying circuit which applies a developing bias voltage obtained by superimposing a DC component on an AC component to the developer carrying member; and a bias voltage controller which controls the voltage of the DC component based on at least one of a voltage range between the highest and lowest voltages of a waveform of the developing bias voltage and the ratio of time during which the waveform has a value higher or lower than a reference voltage to one period of the AC component, said reference voltage being set so that an area occupied by a portion of the waveform of the developing bias voltage in which the developing bias voltage has a value higher than the reference voltage is equal to an area occupied by a portion of the waveform in which the developing bias voltage has a value lower than the reference voltage.

* * * * *